US006861998B2

(12) United States Patent
Louzir et al.

(10) Patent No.: US 6,861,998 B2
(45) Date of Patent: Mar. 1, 2005

(54) TRANSMISSION/RECEPTION SOURCES OF ELECTROMAGNETIC WAVES FOR MULTIREFLECTOR ANTENNA

(75) Inventors: Ali Louzir, Rennes (FR); Philippe Minard, Rennes (FR); Franck Thudor, Rennes (FR); Jean-François Pintos, Pacé (FR)

(73) Assignee: Thomson Licensing S.A., Boulogne-Billancourt (FR)

( * ) Notice: Subject to any disclaimer, the term of this patent is extended or adjusted under 35 U.S.C. 154(b) by 0 days.

(21) Appl. No.: 10/398,834

(22) PCT Filed: Oct. 11, 2001

(86) PCT No.: PCT/FR01/03132

§ 371 (c)(1),
(2), (4) Date: Apr. 9, 2003

(87) PCT Pub. No.: WO02/31920

PCT Pub. Date: Apr. 18, 2002

(65) Prior Publication Data

US 2004/0021612 A1 Feb. 5, 2004

(30) Foreign Application Priority Data

Oct. 12, 2000 (FR) ..... 00 13213

(51) Int. Cl.[7] ..... H01Q 13/00; H01Q 13/001
(52) U.S. Cl. ..... 343/781 P; 343/781 CA
(58) Field of Search ..... 343/781 P, 781 CA, 343/783 CA, 783, 840

(56) References Cited

U.S. PATENT DOCUMENTS 5,041,840 A * 8/1991 Cipolla et al. ..... 343/725
6,320,553 B1 * 11/2001 Ergene ..... 343/781 P
6,720,932 B1 * 4/2004 Flynn et al. ..... 343/786

OTHER PUBLICATIONS

H.E. Bartlett: "A Broadband Five–Horn Cassegrain Feed" International Conference on Antennas and Propagation. Antennas. Nov. 28–30, 1978, I.E.E. Conference Publication, London, vol. Part 1 No. 169, pp. 350–354.

* cited by examiner

*Primary Examiner*—Don Wong
*Assistant Examiner*—Minh Dieu A
(74) *Attorney, Agent, or Firm*—Joseph S. Tripoli; Robert D. Shedd; Kuniyuki Akiyama

(57) ABSTRACT

The present invention relates to an electromagnetic wave transmission/reception source for a multireflector antenna of the Cassegrain type comprising longitudinal-radiation means operating in a first frequency band and an array of n radiating elements of the travelling-wave type operating in a second frequency band with the n radiating elements arranged symmetrically around the longitudinal-radiation means, the array and the longitudinal-radiation means having an approximately common phase centre, the array of n radiating elements being excited by a waveguide of polygonal cross section. The invention applies especially in satellite communication systems operating in the C-, Ku- or Ka-bands.

12 Claims, 6 Drawing Sheets

TRANSMISSION/RECEPTION SOURCES OF ELECTROMAGNETIC WAVES FOR MULTIREFLECTOR ANTENNA

This application claims the benefit, under 35 U.S.C. § 365 of International Application PCT/FR01/03132, filed Oct. 11, 2001, which was published in accordance with PCT Article 21(2) on Apr. 18, 2002 in English and which claims the benefit of French patent application No. 0013213, filed Oct. 12, 2000.

BACKGROUND OF THE INVENTION

The present invention relates to a transmission (T)/reception (R) source antenna, called hereafter a T/R source, that can be placed at the focal point of an antenna system and more particularly at the focal point of a Cassegrain-type double-reflector antenna. One possible application for this T/R source is in satellite communication systems using the C-, Ku- or Ka-bands.

In French Patent Application No. 00/07424 filed on Jun. 9, 2000 in the name of Thomson Multimedia, entitled "Perfectionnement aux antennes-source d'émission/réception d'ondes électromagnétiques", [Improvement to electromagnetic wave transmission/reception source antennas], a hybrid T/R source has been proposed which consists of an array of helices that is excited by an printed feed circuit, surrounding a longitudinal-radiation antenna such as a helix or a "polyrod".

To minimize the interactions between the transmission and reception sources, it is advantageous to use the array of helices for reception and the longitudinal-radiation source for transmission. However, in reception, the losses of the impressed feed circuit have a double effect on the link budget. This is because the G/T ratio of merit of the antenna is reduced because, on the one hand, of the reduction in the gain G of the antenna and, on the other hand, of the increase in the noise temperature T of the system owing to the dissipative losses of the feed circuit. From this standpoint, the solution proposed in Patent Application 00/07424 makes it possible, using an array of helices, preferably with an array of patches, to improve the G/T ratio of the antenna.

Moreover, in French Patent Application 00/07424, the substrate on which the printed feed circuit of the helices is etched, and which includes the receiving circuits of the antenna, is placed perpendicular to the radiation axis of the helices. Thus, in a Cassegrain structure, to avoid blocking by the LNB (Low Noise Block), it is necessary to place the focus of the double reflector system at the apex of the main reflector. This constraint on the geometry of the Cassegrain system requires the use of an overly directional source, which has the effect of increasing the level of the side lobes of the antenna system.

This is because, as illustrated in FIG. 1 which shows schematically a Cassegrain structure comprising a main reflector 1, a source 2 and a secondary reflector 3 facing the source 2, the side lobes principally arise from:

i) the diffraction by the secondary reflector 3. The diffracted energy has an absolute level in dB equal to (G-Edge). G is the gain of the primary source defined essentially by its directivity. For optimum operation of the double-reflector antenna system, Edge is around 20 dB. The level of the side lobes resulting from this diffraction is around the value of (G-Edge);

ii) the side lobes I radiated by the same source 2 and not intercepting the secondary reflector 3. If the primary source 1 has a side lobe level in dB equal to SLL, then the absolute level of the side lobes of the antenna system resulting from the side lobes of the primary source is equal to (G-SLL).

One solution for reducing the lobes of a Cassegrain system is to reduce G. However, as illustrated in FIG. 2, to reduce G and keep an optimum Edge value (of around 20 dB), the focal point 2' of the antenna system must be located between the main reflector 1 and the secondary reflector 3.

BRIEF SUMMARY OF THE INVENTION

The present invention aims to remedy this problem by providing a T/R source structure having its phase centre between the main reflector and the secondary reflector without inducing blocking in the operation of the double-reflector antenna system. It therefore makes it possible to reduce the side lobes of the antenna system.

Furthermore, reducing the side lobe level SLL of the primary source also allows the side lobes of the antenna system to be reduced.

The present invention also provides a novel T/R source structure which allows the side lobes of transmission/reception sources to be reduced.

In addition, contrary to a focusing system based on a homogeneous lens, a double-reflector antenna system has a perfectly defined focal point and, for T/R forces, requires perfect coincidence of their phase centres.

Thus, the present invention also provides a T/R source structure which allows there to be perfect coincidence of the phase centres of the transmission and reception sources.

The subject of the present invention is therefore an electromagnetic wave transmission/reception (T/R) source for a multireflector antenna of the Cassegrain type comprising longitudinal-radiation means operating in a first frequency band and an array of n radiating elements of the travelling-wave type operating in a second frequency band with the n radiating elements arranged symmetrically around the longitudinal-radiation means, the array and the longitudinal-radiation means having an approximately common phase centre, characterized in that the array of n radiating elements is excited by a waveguide of rectangular cross section.

According to one embodiment, the array of n radiating elements is a circular array and the waveguide forms a cavity in the shape of a "slice of pineapple". In this case, the waveguide has dimensions such that, D being the mean diameter of the circular array:

$D=n\lambda_g/2$ where n represents the number of radiating elements and $\lambda_g$ represents the wavelength of the guided wave at the operating frequency;

$\lambda_g=\lambda_0[\epsilon_r-(\lambda_0/\lambda_c)^2]^{-1/2}$, where $\lambda_c$ is the cut-off wavelength of the reactangular waveguide for the $TE_{01}$, fundamental mode, $\lambda_0$ is the wavelength in vacuo and $\epsilon_r$ is the permittivity of the dielectric filling the waveguide; and $\lambda_c=2a(\epsilon_r)^{1/2}$, where a is the width of the rectangular waveguide.

To obtain good directivity of the source, D is chosen such that: $1.3\lambda_0<D<1.9\lambda_0$.

The above rectangular waveguide is excited by a probe connected to the receiving circuits (LNA (Low Noise Amplifier), mixer, etc.) via a coaxial line.

Moreover, for transmission, the longitudinal-radiation antenna, which may be formed either by a "polyrod" excited by a circular or square waveguide or by a long helix excited by a coaxial line, the said helix being located at the centre of the array, has a sort of rear cavity which makes it possible:

1) to reduce the side and rear lobes of the longitudinal-radiation antennae;

2) to make the phase centres of the transmission and reception sources coincident; and 3) to improve the performance in terms of isolation between the transmission and reception sources.

Finally, to reduce the side lobes of the array of helices, a second, conical cavity surrounds the said array.

Further features and advantages of the present invention will become apparent on reading the description given below of various embodiments, this description being given with reference to the drawings appended hereto, in which:

DETAIL DESCRIPTION OF THE INVENTION

To simplify matters, identical elements bear the same reference numbers in the figures.

Various embodiments of the present invention will now be described with reference to FIGS. 3 to 11.

Figure 1:
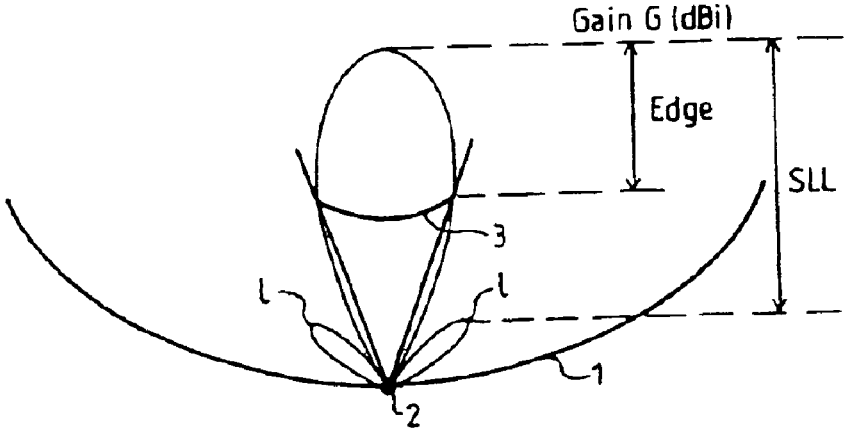
FIG. 1, already described, is a schematic representation of a Cassegrain system according to the prior art.
Figure 2:
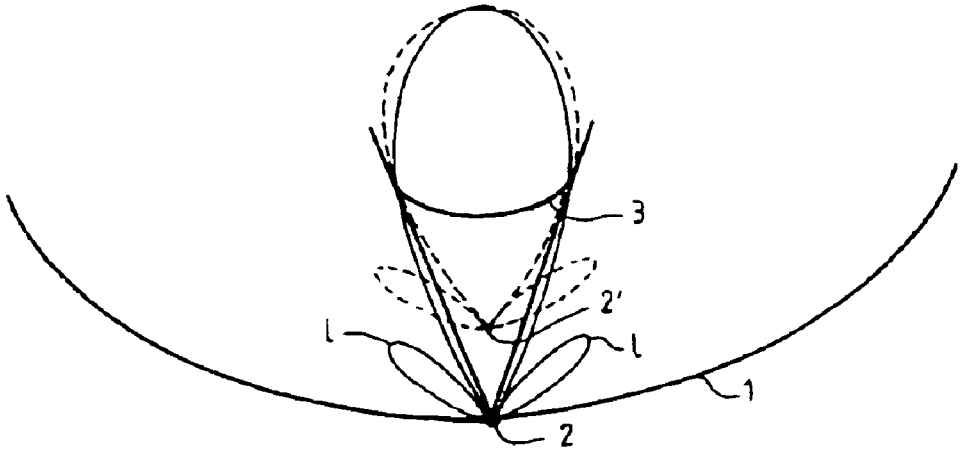
FIG. 2, already described, is a schematic representation corresponding to that of FIG. 1 and explaining one of the problems that the invention aims to solve.
Figure 3:
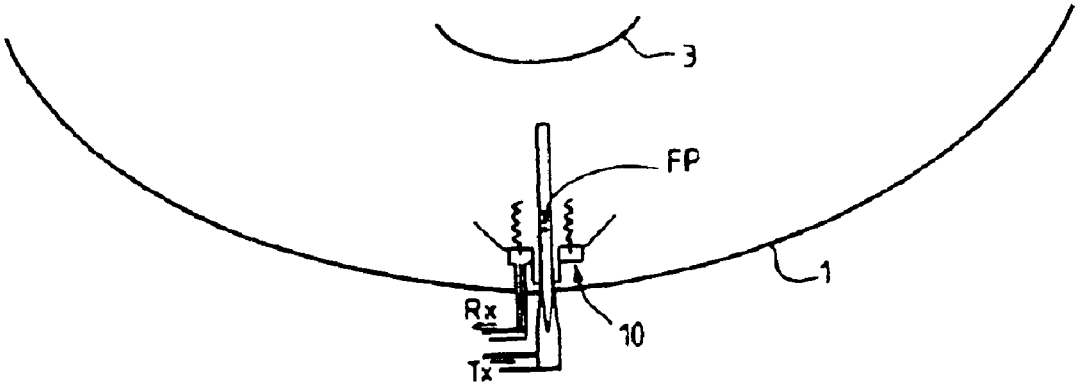
FIG. 3 is a schematic representation of a Cassegrain system comprising a source according to the present invention.

FIG. 3 shows schematically a sectional view of the T/R source 10 forming the subject-matter of the invention, placed at the focal point FP of a double-reflector antenna system located between the two reflectors 1 and 3.

The transmission/reception source antenna forming the subject-matter of the invention benefits, compared with the more conventional solutions using waveguide technology, from the following advantages, namely:

reduced size, reduced weight and reduced cost, at the same time as good electrical isolation between the transmission and reception channels thanks to physical isolation between the two channels.

In addition, compared with the system described in French Patent Application 00/07424:

i) it allows further reduction in the losses of the source consisting of the array of helices, thanks to the very low losses of its feed circuit using a monomode rectangular waveguide, known for these minimal losses, and the length of which is reduced on average to half the perimeter of the circular array;

ii) it provides a low-cost solution to the problem of the excessively high side lobes of Cassegrain-type double-reflector antennas:

by allowing the phase centre of the hybrid source system to be placed between the main reflector and the secondary reflector and by reducing the side lobes of the primary transmission and reception sources;

iii) it allows perfect coincidence of the phase centres of the transmission and reception sources and thus allows the primary source to be positioned optimally both in transmission and reception.

A preferred embodiment of the present invention will now be described in greater detail, with reference to FIGS. 4 to 10.

Figure 4A:
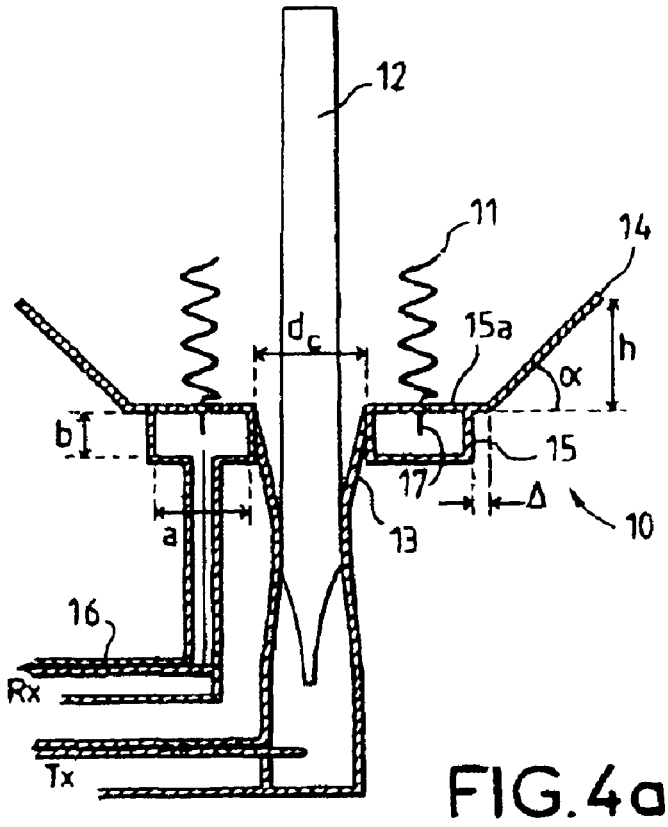
FIGS. 4*a* and 4*b* show a sectional view and a top view, respectively, of a source system according to one embodiment of the present invention.
Figure 4B:
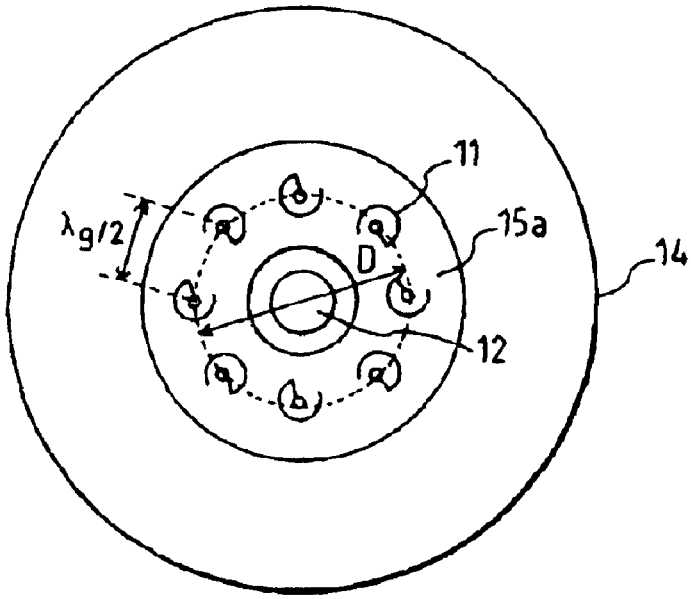

FIGS. 4*a* and 4*b* show a sectional view and a top view, respectively, of the source system forming the subject-matter of the invention. In this particular case:

the array of n radiating elements of the travelling-wave type consists of eight helices 11. They are placed around the circumference of a circle of diameter D and operate in a second frequency band. They are mounted on the upper face 15*a* of a waveguide 15 in the shape of a << slice of pineapple>>;

the longitudinal-radiation antenna located in the middle of the array is a << polyrod>> 12.

Figure 7:
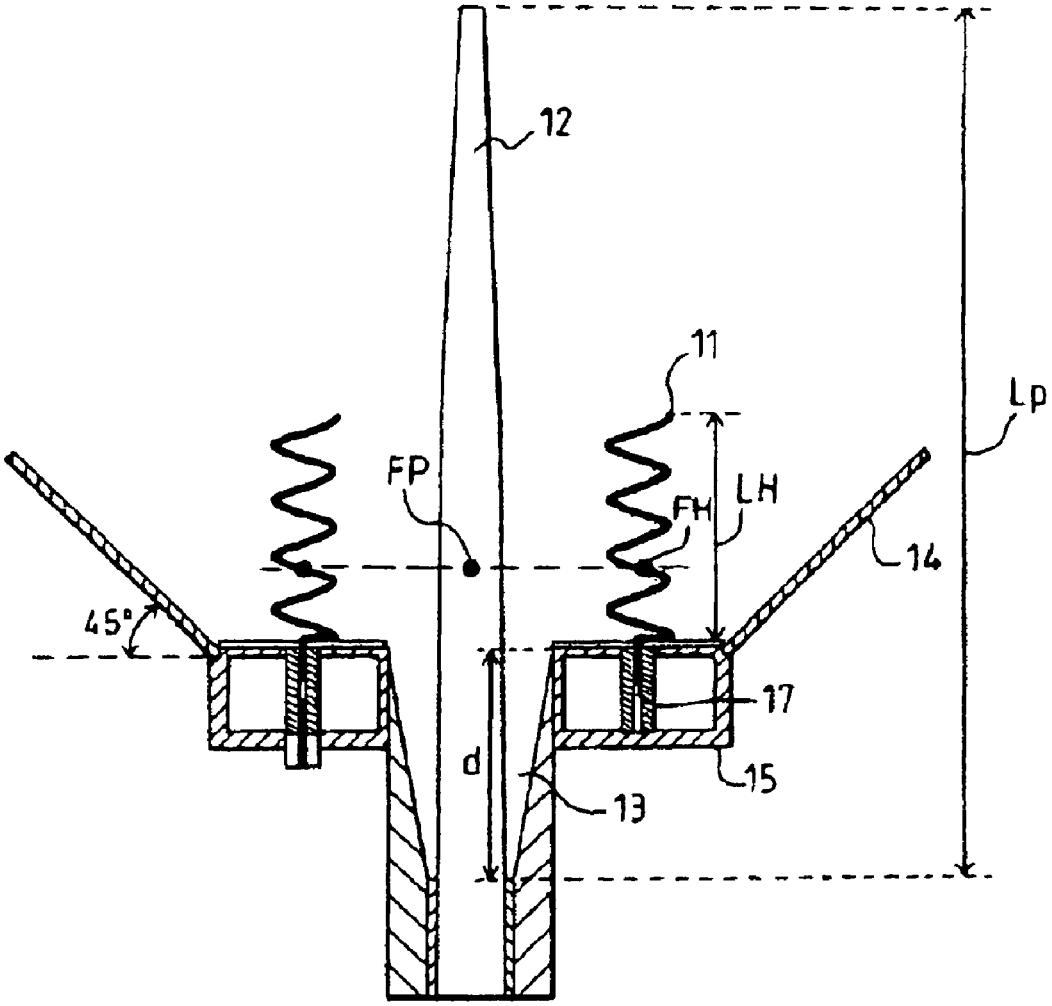
FIG. 7 is a view identical to that of FIG. 4*a*, showing the system produced for simulation.
Figure 8:
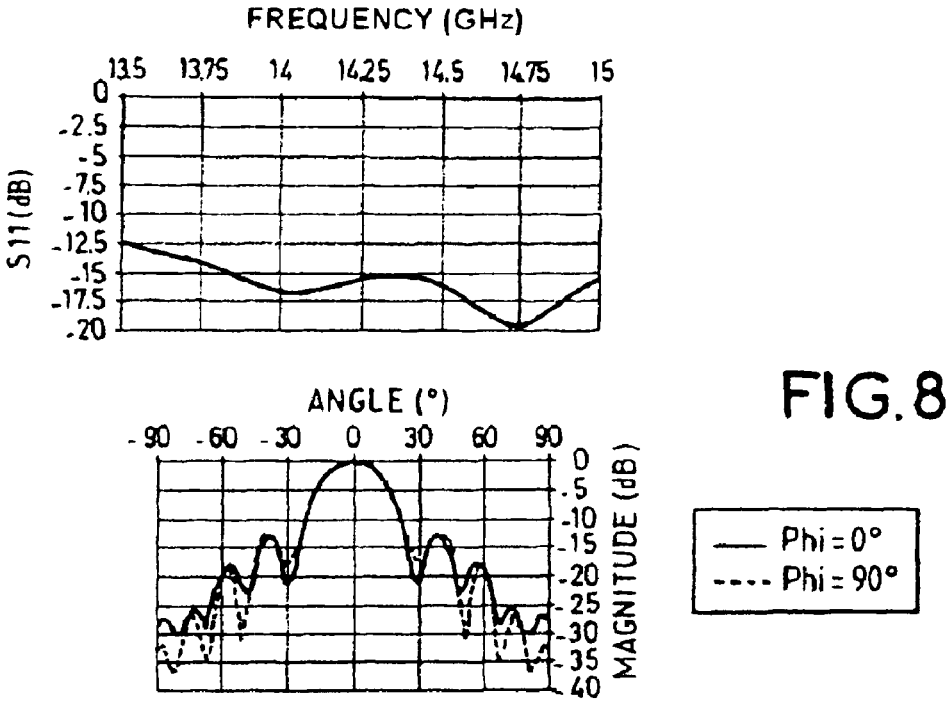
FIGS. 8, 9 and 10 are curves giving results of simulations carried out with the source system of FIG. 7.

As shown in FIGS. 4*a* and 7, the rear cavities 13 and 14 for reducing the radiation of the side lobes both in the case of the << polyrod>> and the array of helices are conical.

The rectangular waveguide 15 in the shape of a << slice of pineapple>> is excited by a coaxial line 16. The radiating helices 11 are in turn coupled via a probe 17 to the rectangular waveguide cavity.

For optimum excitation of the helices, the latter are placed in the middle of the cross section of the waveguide in maximum field planes, namely the open-circuit planes.

Figure 5:
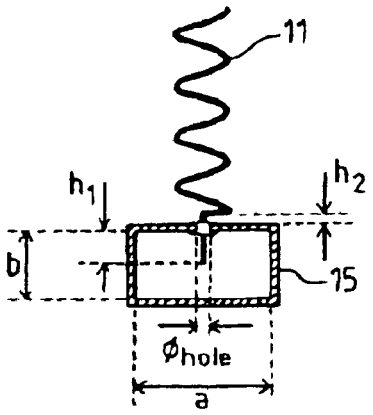
FIG. 5 is a detailed sectional view of a helix used in the system of FIG. 4.

FIG. 5 shows the detail and the dimensions of a helix 11 excited at 12 GHz, mounted on a waveguide 15 of polygonal cross section, more particularly of rectangular cross section with dimensions a and b.

Figure 6A:
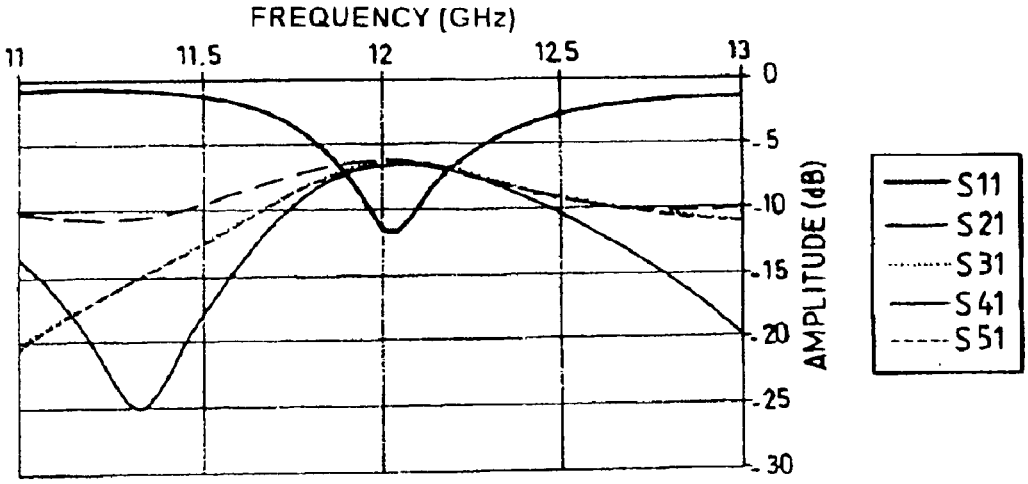
FIG. 6 is a curve giving the results of the coupling of the rectangular waveguide to the helices as a function of frequency.
Figure 6B:
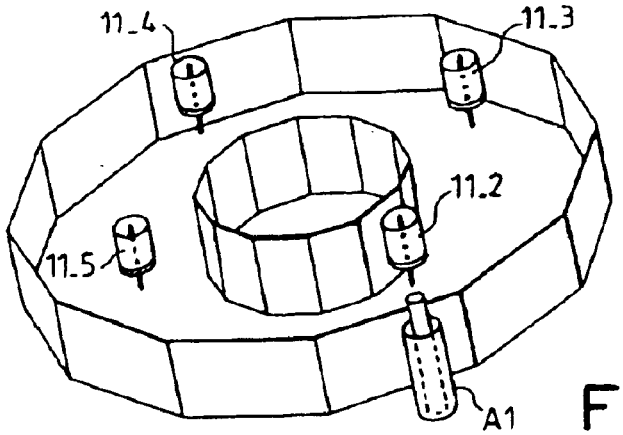

FIG. 6*a* presents simulations showing the result of the coupling of the rectangular waveguide to the helices according to the invention and the matching of the waveguide cavity, at the 12 GHz central frequency, in the case of 4 helices, such as 11-2, 11-3, 114, 11-5, with respect to the port A1 (FIG. 6*b*).

Thus, the dimensions of the rectangular waveguide 15 are as follows:

$D=8\lambda_g/2=4\lambda_g$ (I) (in the case of an array consisting of 8 helices 11); $\lambda_g$ is the wavelength of the guided wave at the operating frequency;

$\lambda_g=\lambda_0[\epsilon_r-(\lambda_0/\lambda_c)^2]^{-1/2}$, (II); $\lambda_c$ is the cut-off wavelength of the rectangular waveguide for the $TE^{10}$ mode and $\lambda_0$ is the wavelength in vacuo;

$\lambda_c=2a(\epsilon_r)^{1/2}$; a is the width of the rectangular waveguide $\epsilon_r$=permittivity of the dielectric filling the waveguide;

moreover, for optimum illumination of the secondary reflector, the directivity of the primary source varies between +/−20° and +/−30° at −20 dB. These directivity values are obtained for mean diameters D such that: $1.3\lambda_0<D<1.9\lambda_0$ (III); $\lambda_0$ being the wavelength in vacuo.

For D fixed by the directivity of the source, Equations (I) and (III) are used to deduce a relationship between $\lambda_g$ and $\lambda_0$. By taking this relationship into account in (II), the value of a is deduced therefrom. To minimize the losses in the rectangular waveguide, the height b of the rectangular waveguide is chosen to be equal to about one half of its width, i.e. b is ~a/2.

In general, to minimize the losses and the cost, the waveguide is chosen to be empty ($\epsilon_r$=1). However, if the waveguide is too wide, or if it is necessary to clear more space in the middle in order to position the polyrod 12 with its rear cavity 13, it suffices to fill the waveguide with a dielectric of permittivity $\epsilon_r$>1. The width of the waveguide is reduced by a factor $(\epsilon_r)^{-1/2}$.

When dimensioning the external cavity, the parameters Δ, α and h are adjusted so as to reduce the side lobe level of the array of helices.

In the case of the internal cavity 13, the diameter $d_c$ is given by the dimensions of the rectangular waveguide 15, and more particularly by its width a. As shown in FIG. 7, the depth d is such that the phase centre FP of the << polyrod>> 12 (which lies approximately at ⅓ of the length of the polyrod) coincides with the phase centre FH of the array of helices 11 (i.e. at the middle of the array of helices and at approximately ⅓ of the length of the helix). Thus, referring to FIG. 7, and starting from an origin located on the base and at the centre of the conical cavity of depth d, the point FP lies at a height of approximately LP/3, where LP is the total length of the polyrod 12 measured from the origin. To make the phase centres coincide, the points FH must be at the same height as FP, which corresponds to the equation:

$$d+LH/3=LP/3, \text{ i.e. } d=(LP-LH)/3;$$

where LH is the length of each of the helices 11.

The dimensions of each of the helices 11 operating in longitudinal mode at the central frequency and also those of the central polyrod as a function of the desired directivities are given by conventional formulae known to those skilled in the art.

Finally, the shape of the rear cavity of the central polyrod may be modified. Thus, instead of a conical shape 13, the rear cavity may have a cylindrical or similar shape.

FIG. 7 shows one particular embodiment of the transmission/reception source forming the subject-matter of the invention. The transmission part is formed by the polyrod 12 and operates in the 14–14.5 GHz band. The reception part operates in the 11.7–12.5 GHz band and is formed by an array of eight helices 11 located on a circle of diameter D=42 mm, i.e. approximately $1.7\lambda_0$ where $\lambda_0$ represents the wavelength in vacuo at the central frequency of the reception band, i.e. $\lambda_0$=24.7 mm.

For this embodiment, the shape of the polyrod 12 has firstly been optimized. The three types of internal cavities (namely a cylindrical cavity, a cylindrical cavity with traps, and a conical cavity), all with a depth of d=30 mm (i.e. approximately (LP-LH)/3=(110-30)/3=26.6 mm) so as to make the phase centres of the two sources coincident, have then been simulated. For this configuration, the conical cavity gives the best result. The matching of the polyrod in the intended band (14–14.5 GHz) and the radiation patterns obtained in the presence of the conical cavity are given in FIG. 8.

Figure 9:
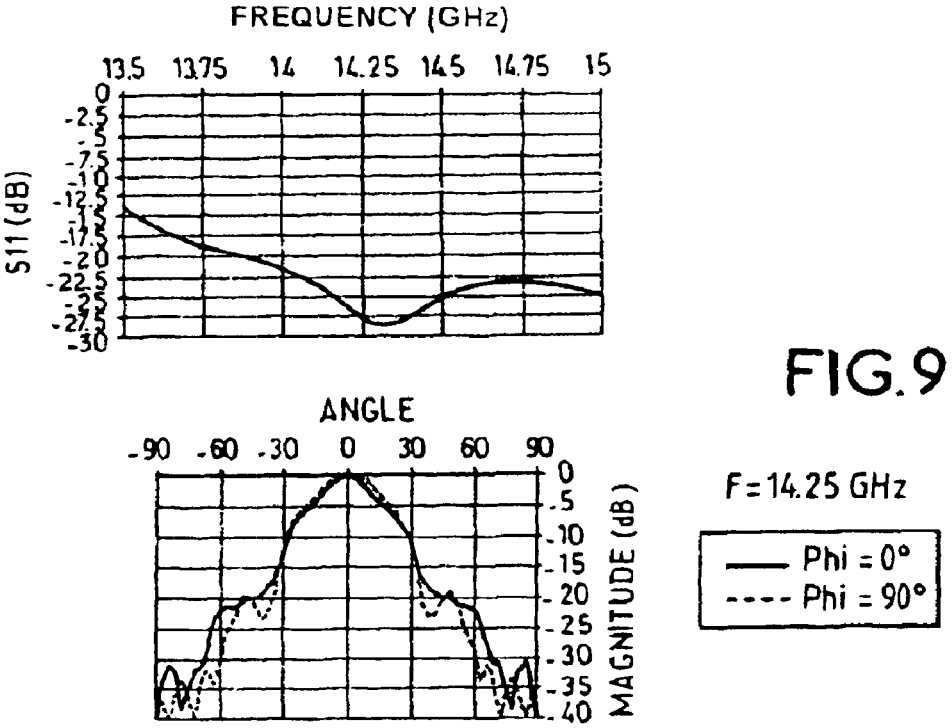

The angle α and the height h of the external conical cavity 14 are then optimized with respect to the side lobes of the polyrod. The best result is then obtained for α=45° and h=25 mm. FIG. 9 shows the results of simulating the matching curve and the radiation patterns obtained for these α and h values. A significant reduction in the side lobe levels in the presence of the external cavity may be noted.

Figure 10:
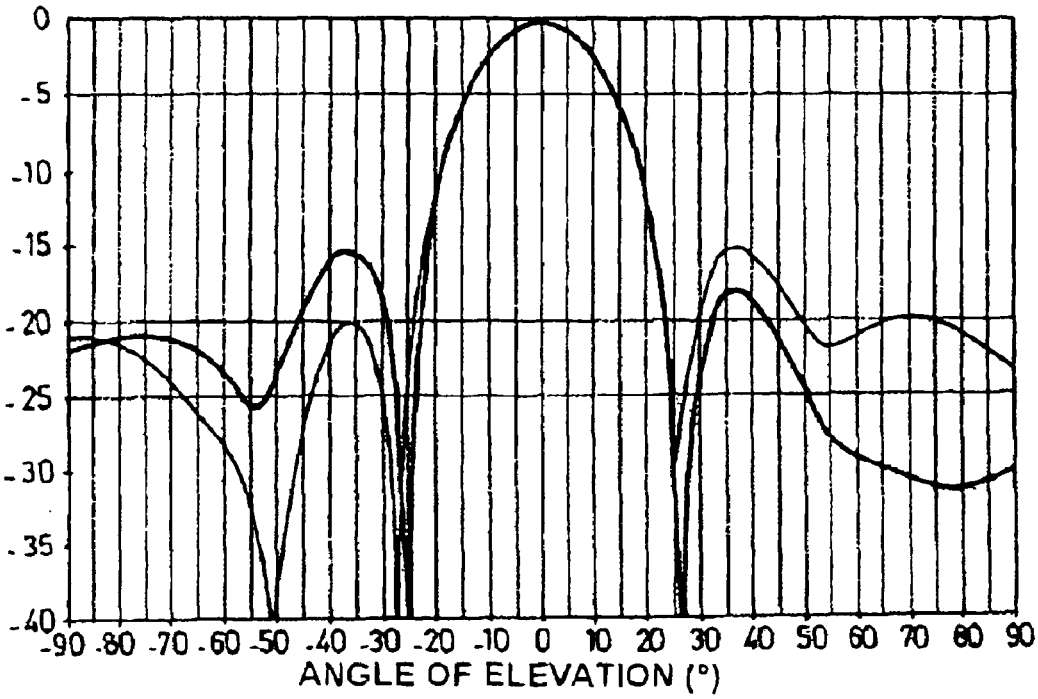

Finally, FIG. 10 shows the radiation patterns of the array of eight helices, all of length 30 mm and uniformly spaced apart on a circle of diameter D=42 mm, i.e. approximately $1.7\lambda_0$ where $\lambda_0$ represents the wavelength in vacuo at the central frequency of the reception band.

Optimizing the side lobes of the reception source by the external cavity results in optimum values of h=25 mm et α=40°. These values are slightly different from those obtained when optimizing the side lobes of the transmission source (h=25 mm et α=45°). These are the values obtained in the case of the transmission source that are preferred, on account of the tighter constraints on the transmission pattern.

Figure 11:
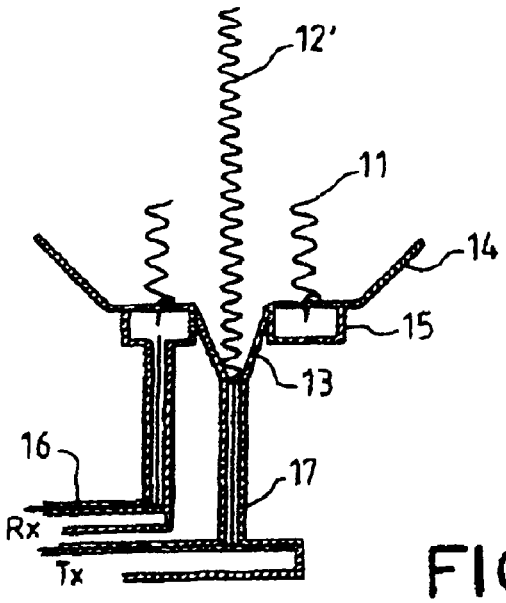
FIG. 11 shows another embodiment of a source system according to the present invention.

FIG. 11 shows an alternative embodiment of the longitudinal-radiation source. In this case, the source is formed by a helix 12 mounted in a conical cavity 13 and coupled via a probe 17 to the feed Tx.

In the embodiments shown, the polarizations of the transmission and reception sources are circular and may be in the same sense or in the opposite sense.

As is obvious to a person skilled in the art, the helix 12' may be positioned in a cylindrical cavity, like the polyrod.

The present invention may be modified in many ways without departing from the scope of the claims appended hereto.

What is claimed is:

1. Electromagnetic wave transmission/reception source for a multireflector antenna of the Cassegrain type comprising longitudinal-radiation means operating in a first frequency band and an array of n radiating elements of the travelling-wave type operating in a second frequency band with the n radiating elements arranged symmetrically around the longitudinal-radiation means, the array and the longitudinal-radiation means having an approximately common phase centre, wherein the array of n radiating elements is excited by a waveguide forming a cavity in the shape of a slice of pineapple of polygonal cross section.

2. Source according to claim 1, wherein in that the array of n radiating elements is a circular array.

3. Source according to claim 1, wherein the waveguide has dimensions such that, D being the mean diameter of the circular array:

$D=n\lambda_g/2$ where n represents the number of radiating elements and $\lambda_g$ represents the wavelength of the guided wave at the operating frequency;

$\lambda_g=\lambda_0[\epsilon_r-(\lambda_0/\lambda_c)^2]^{-1/2}$, where $\lambda_c$ is the cut-off wavelength of the waveguide for the $TE_{01}$ fundamental mode, $\lambda_0$ is the wavelength in vacuo and $\epsilon_r$ is the permittivity of the dielectric filling the waveguide; and $\lambda_c=2a(\epsilon_r)^{1/2}$, where a is the width of the rectangular waveguide.

4. Source according to claim 3, characterized in that D is chosen such that:

$1.3k_o<D<1.92,0$.

5. Source according to claim 1, wherein the waveguide is filled with a dielectric of permittivity <1.

6. Source according to claim 1, wherein the radiating elements of the traveling-wave type are helices.

7. Source according to claim 1, wherein the longitudinal-radiation means consist of a longitudinal-radiation dielectric rod or "polyrod" whose axis is coincident with the radiation axis, the said rod being excited by means comprising a waveguide.

8. Source according to claim 1, wherein the longitudinal-radiation means consist of a device in the form of a helix whose axis is coincident with the radiation axis, the said device being excited by means comprising a coaxial line.

9. Source according to claim 7, wherein the longitudinal-radiation means are surrounded by a cavity that reduces the side lobes.

10. Source according to claim 8, wherein the longitudinal radiation means are surrounded by a cavity that reduces the side lobes.

11. Electromagnetic wave transmission/reception source for a multireflector antenna of the Cassegrain type comprising longitudinal-radiation means operating in a first frequency band and an array of n radiating elements of the travelling-wave type operating in a second frequency band with the n radiating elements arranged symmetrically around the longitudinal-radiation means, the array and the longitudinal-radiation means having an approximately common phase centre, the array of n radiating elements being excited by a waveguide of polygonal cross section, wherein the waveguide has dimensions such that, D being the mean diameter of the array:

$D=n\lambda_g/2$ where n represents the number of radiating elements and $\lambda_g$ represents the wavelength of the guided wave at the operating frequency;

$\lambda_g=\lambda_0[\epsilon_r-(\lambda_0/\lambda_c)^2]^{-1/2}$, where $\lambda_c$ is the cut-off wavelength waveguide for the $TE_{01}$ fundamental mode, $\lambda_0$ is the wavelength in vacuo and $\epsilon_r$ is the permittivity of the dielectric filling the waveguide; and $\lambda_c=2a(\epsilon_r)^{1/2}$, where a is the width of the rectangular waveguide.

12. Source according to claim 11, wherein D is chosen such that:

$1.3\lambda_{0<D<1.9}\lambda_0$.

* * * * *